US007086937B2

(12) United States Patent
Wakazono et al.

(10) Patent No.: US 7,086,937 B2
(45) Date of Patent: Aug. 8, 2006

(54) WHEEL SHAFT SUPPORTING APPARATUS FOR GRINDING MACHINE

(75) Inventors: Yoshio Wakazono, Nagoya (JP); Masashi Yoritsune, Anjo (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 183 days.

(21) Appl. No.: 10/842,487

(22) Filed: May 11, 2004

(65) Prior Publication Data

US 2004/0242125 A1 Dec. 2, 2004

(30) Foreign Application Priority Data

May 30, 2003 (JP) ..... 2003-154472
Jun. 4, 2003 (JP) ..... 2003-159323
Jul. 9, 2003 (JP) ..... 2003-194071

(51) Int. Cl.
*B24B 41/06* (2006.01)

(52) U.S. Cl. ..... 451/342; 451/360

(58) Field of Classification Search ..... 451/340, 451/342, 343, 360
See application file for complete search history.

(56) References Cited

U.S. PATENT DOCUMENTS 826,944 A * 7/1906 Krieger ..... 403/333
3,881,234 A * 5/1975 Crowell et al. ..... 492/15
4,391,357 A * 7/1983 Bindernagel et al. ..... 192/94

FOREIGN PATENT DOCUMENTS

EP 0 454 093 10/1991
JP 59-161265 9/1984
JP 6-47662 2/1994

* cited by examiner

*Primary Examiner*—Timothy V. Eley
(74) *Attorney, Agent, or Firm*—Oblon, Spivak, McClelland, Maier & Neustadt, P.C.

(57) ABSTRACT

A pair of hydrostatic radial bearing devices 42, 43 is mounted on right and left side surface of a front portion of a wheel slide 34 in order to support rotatably wheel shafts 45, 52 respectively. A thrust bearing device 45 mounted in either one of wheel shafts 45, 52 supports either wheel shaft 45 or 52 in a thrust direction. A shaft coupling mechanism 60 is installed in wheel shafts 45, 52. A taper cylindrical portion 61 is projected from either one of wheel shafts 45, 52 and fitted tightly with a taper inside opening 65 formed in remaining of wheel shafts 45, 52. A vertical end surface 52*t*, 49*t* or Fb extending from a base of the taper cylindrical portion 61 is fitted tightly with another vertical end surface 45*t*, 52*t* or 45*t* of the remaining wheel shaft 45 or 52.

38 Claims, 11 Drawing Sheets

WHEEL SHAFT SUPPORTING APPARATUS FOR GRINDING MACHINE

INCORPORATION BY REFERENCE

The present application claims priority under 35 U.S.C. §119 to Japanese Patent Applications No. 2003-154472, filed on May 30, 2003, No. 2003-159323, filed Jun. 4, 2003 and No. 2003-194071, filed Jul. 9, 2003. The contents of those applications are incorporated herein by references in their entirety.

BACKGROUND OF THE INVENTOIN

1. Field of the Invention

The present invention relates to a wheel shaft supporting apparatus installed in a front portion of a wheel slide of a grinding machine, especially of a cylindrical grinding machine.

2. Description of the Related Art

It is well known for a grinding machine to support a wheel shaft at both sides thereof to enforce supporting stiffness for a grinding wheel, for example it is disclosed in Japanese patent laid-open publication No. S59-161265. In this well known grinding machine, both sides of the wheel shaft mounting a grinding wheel at center is supported respectively and rotatably by right and left hydrostatic fluid bearing devices, one of hydrostatic fluid bearing devices has a hydrostatic thrust bearing mechanism. It is well known technology for a grinding machine supporting a grinding wheel at both sides of the wheel shaft to change the grinding wheel mounted at center on the wheel shaft, for example this technology is disclosed in Japanese patent laid-open publication No. H6-47662 or No. H6-47663. In these well known grinding machines, a pair of wheel shafts disposed at each side of the grinding wheel supports rotatably the grinding wheel especially by a hydrostatic fluid bearing device, and it equips a combining means coupling the opposite ends of both wheel shafts. In order to disassemble the grinding wheel, the combining means is operated into non-combining state thereby to apart one wheel shaft from the other wheel shaft so that the grinding wheel is ready to be removed. The combination of these opposite end of both wheel shafts is performed in such a manner that a taper cone projected from the end surface of one wheel shaft is inserted into a taper inside opening of the other wheel shaft and a screw ring screwing the outer end surface of the one wheel shaft secures the taper cone to the taper inside opening.

However in the well known grinding machines in above-mentioned second and third related art, since the combining means of the one and the other wheel shafts is performed by the taper cone and the taper inside opening, therefore high accurate repeatability of coincidence between each center line of both wheel shafts can not be achieved when both wheel shafts are reassembled again because of changes in a taper surface fitting between the taper cone and the taper inside opening so that it is difficult to increase coupling stiffness between the wheel shafts. Further, since the grinding wheel is fitted tightly by a vertical surface fitting between the grinding wheel and a flange and a position of the vertical surface fitting is apart from the taper surface fitting between the taper cone and the taper inside opening in the well known grinding machine, therefore high accurate repeatability of coincidence between each center line of the grinding wheel and both wheel shafts can not be achieved when a new grinding wheel and both wheel shafts are reassembled again so that it is difficult to increase stiffness of the grinding wheel, too. And also, since the screw ring and a matching screw portion of the outer end surface of the one wheel shaft are exposed outside from the one wheel shaft in the well known grinding machine, the invaders such as ground pieces, grinding particles, coolant, etc act to pollute and corrode the screw ring and screw portion thereby not to operate the securing at the assembling and disassembling process after long term operation because the grinding wheel comprising a cubic boron nitride (CBN) can be operated for long term. More over, since a motor for the grinding wheel is arranged in a line of an axis of the grinding wheel in the well known grinding machine, it can happen that the motor for the grinding wheel interferes other components of the grinding machine where a diameter of the grinding wheel is smaller than that of the motor thereby to prevent from equipping the grinding wheel with the smaller diameter which is easy to be changed. Further more, since a position in thrust direction of the wheel shaft is affected by thrust bearing accuracy of an output shaft of the driving motor and positioning accuracy of a coupling combining the output shaft of the motor with the wheel shaft, the positioning accuracy of the output shaft, in other word a positioning accuracy of the grinding wheel in the thrust direction is worse to prevent from machining a workpiece into high accuracy in the thrust direction. After the screw ring is removed from the screw portion of the one wheel shaft thereby to remove the grinding wheel from the wheel shaft in disassembling process, in assembling process a new grinding wheel is mounted on the wheel shaft and secured by the screw ring to the wheel shaft so that it needs a lot of process in the disassembling and assembling. Especially it is difficult to change the grinding wheel in so narrow area restricted by the pair of wheel shafts so that it make more difficult change the grinding wheel.

SUMMARY OF THE INVENTION

In view of the previously mentioned circumstances, it is an object of the present invention to provide a wheel shaft supporting apparatus for a grinding machine achieving easy assembling and disassembling of a grinding wheel supported by a pair of wheel shafts and increasing centering accuracy of both wheel shafts and stiffness in combined wheel shaft.

It is second object of the present invention to provide the wheel shaft supporting apparatus for the grinding machine dividing supporting force into two wheel shafts thereby to enforce supporting stiffness.

It is third object of the present invention to provide the wheel shaft supporting apparatus for the grinding machine achieving a easy combining and un-combining process of both wheel shafts.

It is fourth object of the present invention to provide the wheel shaft supporting apparatus for the grinding machine keeping a center of both wheel shafts in constant.

It is fifth object of the present invention to provide the wheel shaft supporting apparatus for the grinding machine rotating the grinding wheel without unbalancing thereby to achieve the high accurate grinding.

In order to achieve the above and other objects, the present invention provides a wheel shaft supporting apparatus for a grinding machine comprising mainly such constructions that a grinding wheel is supported by a pair of wheel shafts combined and uncombined with each other by a shaft coupling mechanism; the shaft coupling mechanism having a cylindrical taper portion formed on one of wheel shafts is tightly fitted with a taper inside opening formed in the other of wheel shafts for a taper surface coupling; and a vertical end surface formed on said one wheel shaft and extending from a base of the taper cylindrical portion is tightly fitted with an another vertical end surface formed on the end portion of said other wheel shaft as vertical surface fitting, wherein both wheel shafts are combined by the taper surface fitting and the vertical surface fitting continuous to the taper surface fitting. By these constructions, since both wheel shafts are combined by two tightly fittings of the taper surface fitting and the vertical surface fitting continuous to the taper surface fitting mechanically, the vertical end surfaces especially the end portions of both wheel shafts are repulsed each other against the bending moment acting on the wheel shafts strongly. Thus, axial stiffness of combined wheel shafts is improved to keep in a precise cutting position of the grinding wheel against cutting resistance thereby to increase a grinding accuracy of a ground workpiece. Since the shaft coupling mechanism is installed in wheel shafts at opposite ends thereof, it is prevented that any invaders such as ground pieces, grinding particles, coolant, etc come into the shaft coupling mechanism.

Second aspect of the present invention is that said wheel shaft supporting apparatus further comprises a flange portion extending from either one of wheel shafts in a diameter direction thereof and secured said grinding wheel by bolts; and an inner surface of said grinding wheel fits directly or indirectly on an outer peripheral surface of the remaining of wheel shafts. By these constructions, since the grinding wheel is supported by one wheel shaft through the flange and by the other wheel shaft through the inner surface thereof, supporting force is divided into two wheel shafts thereby to enforce supporting stiffness. Therefore, the grinding wheel itself acts as compensation means for compensating the bending moment against them acting on both wheel shafts so that it is easy to set a center of the grinding wheel against both wheel shafts and it increases stiffness of both wheel shafts.

Third aspect of the present invention is that the shaft coupling mechanism is installed in the taper cylindrical portion and comprises therein an insertion hole in a diameter direction; said shaft coupling mechanism further comprises a pin installed in said insertion hole and having an operating socket at at least one of ends thereof; said other wheel shaft comprises an another insertion hole in a line with said insertion hole of said taper cylindrical portion and said socket. By these constructions, a suitable operational means such as a hexagonal wrench is inserted into both insertion holes to operate the shaft coupling mechanism so that both wheel shafts are combined or uncombined each other easily. It may be constructed that the inner surface of the grinding wheel shields the insertion hole opened from the outer peripheral surface of the other wheel shaft thereby to prevent the invaders such as ground pieces, grinding particles, coolant, etc come into the coupling mechanism.

Fourth aspect of the present invention is that both wheel shafts are supported by each of hydrostatic radial bearing devices respectively so that a center of both wheel shafts is kept in constant because of centering operation of hydrostatic bearing thereby to achieve high accurate grinding. Further more, it may constructed that a thrust bearing device for either one of wheel shafts is a hydrostatic or an angular contact bearing device, especially the angular contact bearing device achieves to support in both radial and thrust directions. Therefore, the angular contact bearing device keeps positional accuracy of the wheel shaft in the thrust direction and supports with the hydrostatic radial bearing device dividedly radial directional force such as grinding force and a pulley belt tension.

Fifth aspect of the present invention is that an automatic balancing mechanism mounted in either one of wheel shafts and automatically balancing a whole rotating system including both wheel shafts. Thereby, the grinding wheel is rotated without unbalancing to achieve the high accurate grinding.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
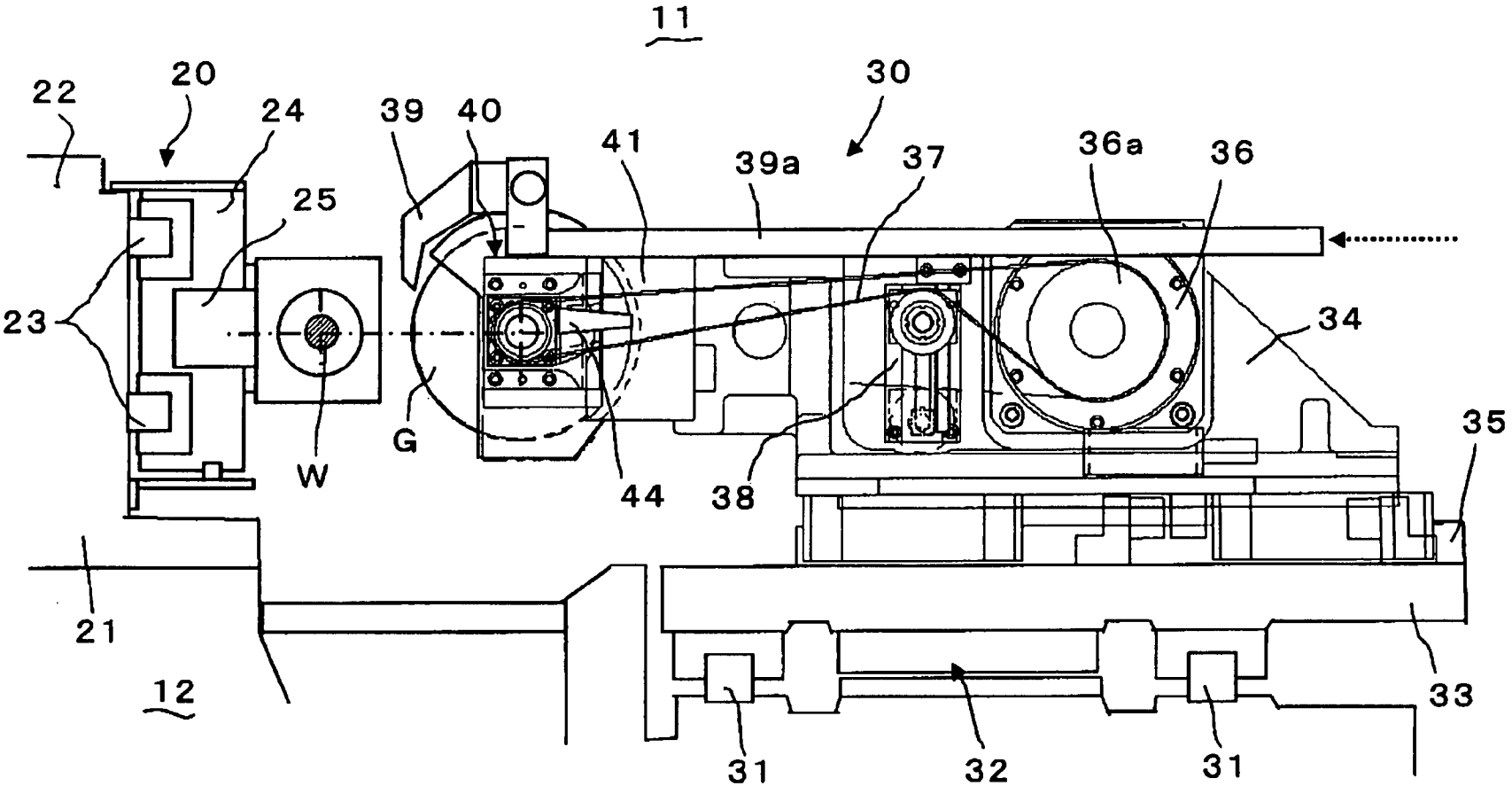
FIG. 1 is a side view of the grinding machine equipped on the wheel shaft supporting apparatus of the first embodiment according to the present invention.

A first preferred embodiment of the wheel shaft supporting apparatus for the grinding machine according to the present invention will be described referring to FIG. 1 to FIG. 5. In FIG. 1, numeral 11 indicates a cylindrical grinding machine having a bed 12. The bed 12 equips a workpiece driving device 20 on a top surface and in a front portion of the bed 12 as shown at left side of FIG. 1. The bed 12 also equips a workpiece table 21 mounted fixedly thereon and vertically. The workpiece driving device 20 is fixed along a pair of linear guides 23 on a side of a supporter 22 to be adjustable in a direction perpendicular to a plane of FIG. 1. The workpiece driving device 20 comprises a spindle head 24 and an unillustrated tail stock to support a workpiece W rotatably around a horizontal line and the workpiece W is rotated by a spindle motor 25.

Faced to the workpiece driving device 20, a wheel head device 30 is mounted along a pair of linear guides 31 extending in the direction perpendicular to the plane of FIG. 1 on a top surface of a rear portion of the bed 12 and comprises a wheel slide 33 moved by a linear motor 32 in right and left directions in an operator's point of view. The wheel head 34 is mounted along a pair of linear guides 35, one of which is shown in FIG. 1, on the wheel slide 33 and is moved along the linear guides 35 in advance and retraction, that is in right and left directions shown in FIG. 1. In a front portion of the wheel head 34 is mounted a wheel shaft supporting unit 40 supporting rotatably a wheel shaft, described hereinafter, to which a grinding wheel G is fixed. The grinding wheel G is connected in rotation through a pulley 36*a* and a belt 37 to an output shaft of a driving motor 36, therefore, rotating power from the driving motor 36 is transmitted to the grinding wheel G. Besides, a numeral 38 shows a belt tension adjusting mechanism, 39 shows a coolant supplying nozzle and 39*a* shows feed line sending coolant to the coolant supplying nozzle 39.

Figure 2:
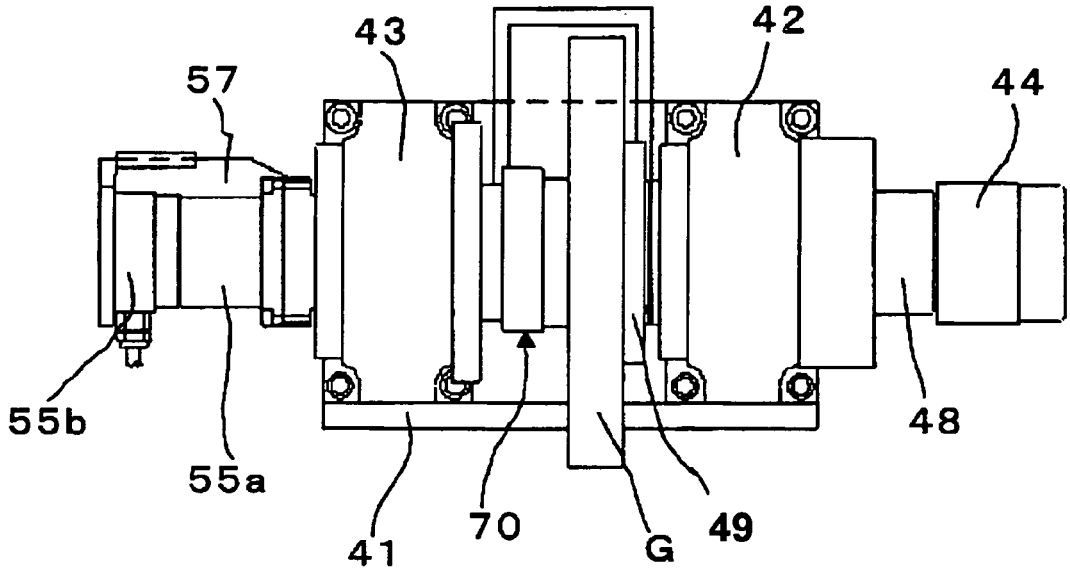
FIG. 2 is a front view of the wheel shaft supporting apparatus for the grinding machine according to the first embodiment of the present invention.
Figure 3:
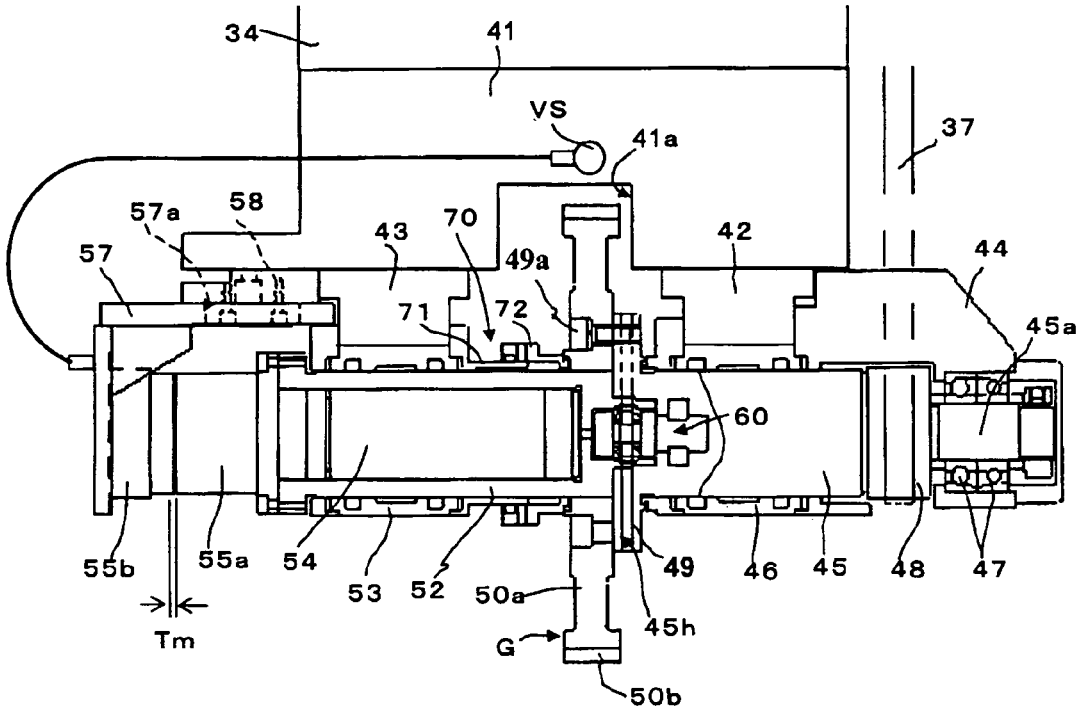
FIG. 3 is a horizontal cross sectional view of the wheel shaft supporting apparatus for the grinding machine according to the first embodiment of the present invention.
Figure 4:
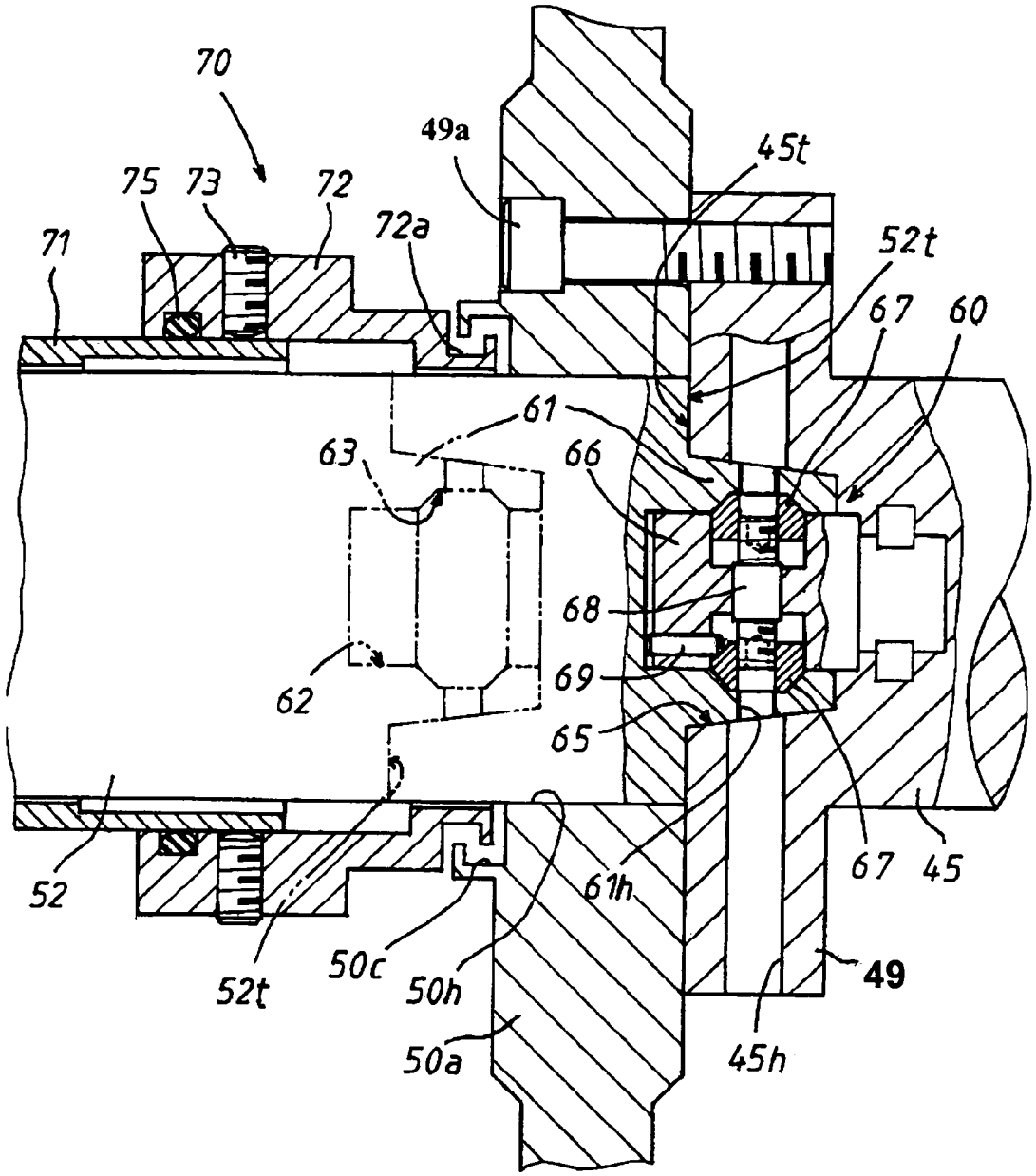
FIG. 4 is a partial enlarged view including the shaft coupling mechanism mounted in wheel shafts and the telescopic cover mechanism covering the shaft coupling mechanism according to the first embodiment of the present invention.
Figure 5:
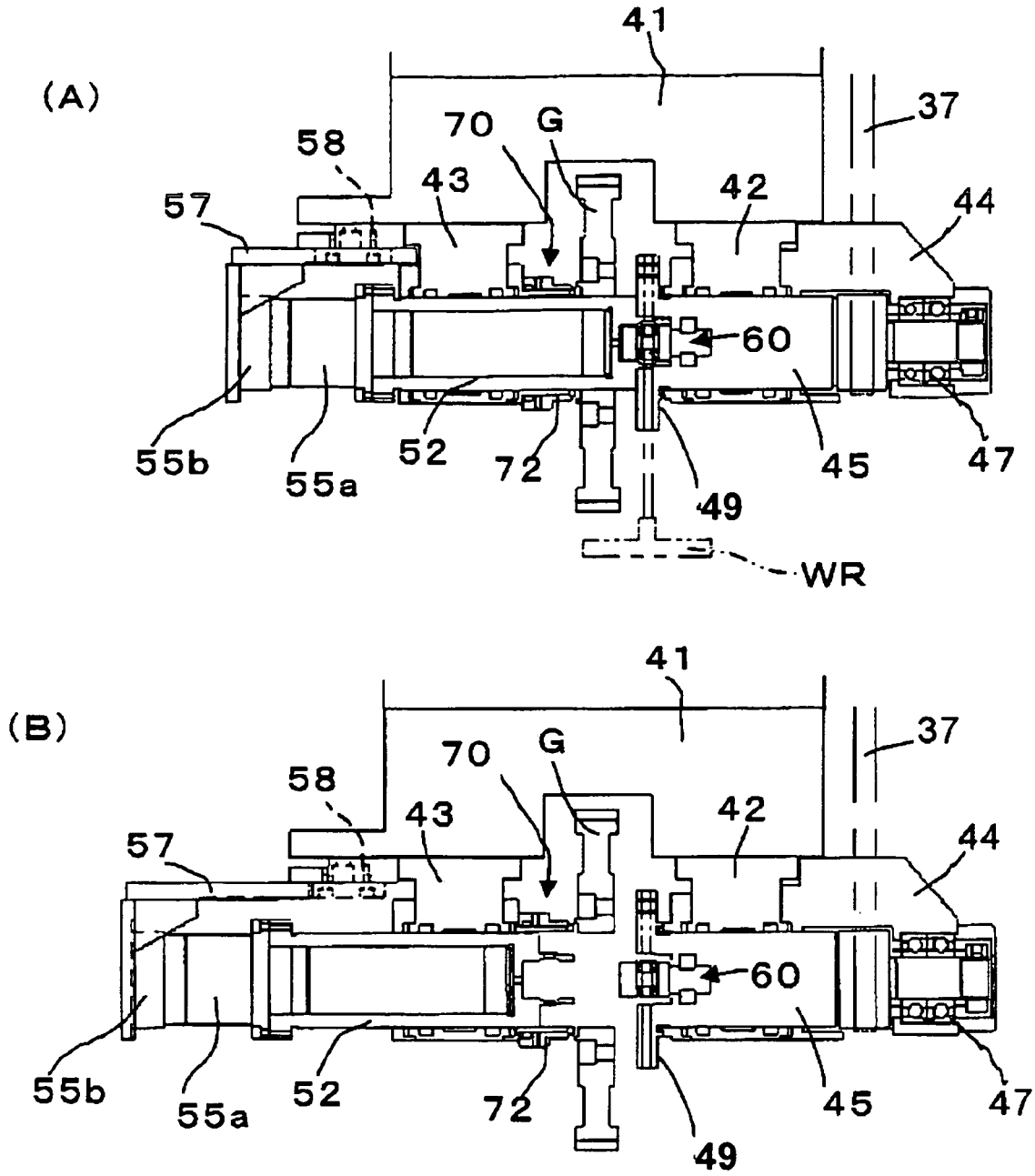
FIGS. 5(A) and (B) are an explanatory diagram for assembling and disassembling the grinding wheel according to the first embodiment of the present invention.

It is now described the wheel shaft supporting apparatus 40 referring to FIG. 2 to FIG. 4 showing respectively a front view, a plane view and an enlarged plane cross sectional view. Main compositions in the wheel shaft bearing apparatus 40 are a unit base 41, radial bearing device 42, 43 disposed respectively in right side and left side from the operator's view point and secured respectively by bolts at four corners, and a thrust bearing device 44 at the end of the right side. The unit base 41 forms an arc space 41*a* enclosing a part of a peripheral portion of the grinding wheel G in its central space. The right radial bearing device 42 secured to a front surface of the unit base 41 at right side from the arc space 41*a*. The radial bearing device 42 comprises a hydrostatic fluid bearing rotatably supporting a main wheel shaft 45 by hydrostatic pressure generated as oil pressure inside peripheral surface of a bearing metal 46. The main wheel shaft 45 forms a small diameter portion 45*a* which is rotatably supported by a pair of angular contact bearings 47 in the thrust bearing device 44. Thus, the pair of angular contact bearings 47 performs functions as not only a roller bearing in radial direction but also a thrust bearing in thrust direction supporting rotatably the main wheel shaft 45 to restrict movement thereof in an axial direction.

The main wheel shaft 45 extends into the thrust bearing device 44 and the radial bearing device 42 adjacent thereto, and a pulley 48 engaging with the belt 37 is fixed by a key on the main wheel shaft 45 between the trust bearing device 44 and the radial bearing device 42. A belt tension acting on the pulley 48 by the belt tension adjusting mechanism 38 is dividedly supported on both sides of the pulley 48 by the hydrostatic pressure in the radial bearing device 42 and the angular contact bearing 47 in the thrust bearing device 44 in order to make a large resistance against the belt tension. It can be compact for whole size of the angular contact bearing 47 because the small diameter portion 45*a* is supported by the thrust bearing device 44. Therefore, a rotating peripheral speed of the bearing 47 is reduced to restrain generation of heat and to reduce consumption of rotating power of the driving motor 36, thus to achieve effects of energy saving.

The main wheel shaft 45 forms a flange portion 49 with enlarged diameter at a left end portion thereof and includes a shaft coupling mechanism 60 therein. The grinding wheel G is detachably fixed to a side surface of the flange portion 49 by a plurality of bolts 49*a*, for example six bolts 49*a*, that are disposed at even peripheral angle of the flange portion 49. The grinding wheel G includes a wheel base 50*a* made from for example a metal, and grinding particle layer 50*b* made from for example Cubic Boron Nitride (CBN) as supper abrasive particles on a peripheral surface of the wheel base 50*a*. The shaft coupling mechanism 60 combines a sub wheel shaft 52 with the main wheel shaft 45 as a function of single body, thereby to support the grinding wheel G by the main and sub radial bearing devices 42, 43 at both of right and left side of the grinding wheel G.

The sub radial bearing device 43 is secured to a left front surface of the unit base 41 opposite to the main bearing device 42 at the arc space 41*a*. The radial bearing device 43 comprises a hydrostatic fluid bearing rotatably supporting a sub wheel shaft 52 around a same axis to a rotation axis of the main wheel shaft 45 by hydrostatic pressure generated as oil pressure inside peripheral surface of a bearing metal 53. The sub wheel shaft 52 forms a cylindrical blind hole, from a left end side, in which an automatic balancing mechanism 54 is assembled. The automatic balancing mechanism 54 is well known mechanism automatically to balance rotating bodies including grinding wheel G and the main and sub wheel shafts 45, 52 combined by the shaft coupling mechanism 60 as a whole. In detail, the automatic balancing mechanism 54 includes a pair of weights to move independently these weights to minimum unbalance position in a peripheral direction by a pair of independent motors. A rotatable signal sending/receiving device 55*a* is mounted on the left end side of the sub wheel shaft 52, and includes a driving control circuit to control for driving the motor assembled in the balancing device 54. An unillustrated acoustic emission (AE) sensor is installed in the balancing device 54, and the signal sending/receiving device 55*a* outputs a signal from the AE sensor to detect a contact between the grinding wheel G and the workpiece W. A non-rotatable signal sending/receiving device 55*b* is fixed to a supporting bracket 57 with a small clearance Tm from a right end surface thereof to a left end surface of the rotatable signal sending/receiving device 55*a* in order to send and receive the signals and the driving power to the motors in the automatic balancing device 54 by wireless. Thus, the non-rotatable signal sending/receiving device 55*b* supplies the driving power to said motors and receives a detection signal from a vibration sensor VS installed on the unit base 41 at a suitable position such as back and adjacent to the grinding wheel G. And also, the non-rotatable signal sending/receiving device 55*b* receives the AE signal from the rotatable signal sending/receiving device 55*a* to input them into an unillustrated Computer Numerical Controller (CNC) controlling the cylindrical grinding machine. The supporting bracket 57 is fixed on the unit base 41 by bolts 58 inserted into a long hole 57*a*. Thereby, the supporting bracket 57 mounting the non-rotatable signal sending/receiving device 55*b* is slidably adjusted in right/left directions to make the clearance Tm suitable. Therefore, the supporting bracket 57 and the non-rotatable signal sending/receiving device 55*b* are performs the function of a restriction of a left movement of the sub wheel shaft 52 as a restriction member. The restriction member prevents the axial left movement of the sub wheel shaft 52 departing from the main wheel shaft 45 in rotating thereby to act as a safety means against forgetting of combining of both wheel shafts 45, 52, incomplete combining, un-expecting accident, etc.

FIG. 4 shows the enlarged cross sectional view of coupling portion between the main and sub wheel shafts 45, 52 assembled by the shaft coupling mechanism 60 therein. A taper cylindrical portion 61 is projected from a right end side of the sub wheel shaft 52. The taper cylindrical portion 61 forms a cylindrical hole 62 and an enlarged hole 63. The sub wheel shaft 52 has a vertical end surface 52*t* extending from a base of the taper cylindrical portion 61. On the other hand, a left side portion of the main wheel shaft 45 forms a taper inside opening 65 receiving the taper cylindrical portion 61 and tightly fitting with an outer peripheral surface of the taper cylindrical portion 61. And an end surface of the main wheel shaft 45 forms another vertical end surface 45*t* contacting tightly to the vertical end surface 52*t*. Thereby as explained detailed hereafter in an explanation of an operation of the first embodiment, the taper surface fitting between the taper cylindrical portion 61 and the taper inside opening 65 is mechanically continued through said base to the vertical surface fitting between the vertical end surface 45*t* and 52*t*. The taper inside opening 65 faces to a coupling portion of a coupling head 66 that is substantially cylindrical, a base of which is fitted tightly with the main wheel shaft 45. Said coupling portion forms receiving grooves, at opposite ends of a peripheral portion thereof in a diameter direction, in which coupling pieces 67, 67 are moved to project and retract in the diameter direction. The coupling pieces 67, 67 contacts in screw engagement with a pair of screw portions formed at opposite ends of a screw pin 68 that is inserted into the coupling portion. Each of screw portions has a lead opposite to each other. The screw pin 68 forms operating portion at opposite end surfaces having such as hexagonal wrench sockets. In the same center line to that of wrench sockets, insertion holes 45*h* and 61*h* for a wrench WR are formed in the flange portion 49 and the taper cylindrical portion 61 transversely in the diameter direction. Thus as shown in a two dotted line in FIG. 5, the wrench WR is inserted into the wrench socket of the screw pin 68 through the insertion holes 45*h* and 61*h*, and rotates the screw pin 68 in order to index selectively the pair of coupling pieces 67, 67 in two positions, one of which is a coupling position to engage the pair of coupling pieces 67, 67 with the enlarged hole 63 of the taper cylindrical portion 61 by projecting the pair of coupling pieces 67, 67 in the diameter direction thereby to expand an outer surface of the taper cylindrical portion 61 a little amount, and the other of which is a releasing position to retract to be buried the pair of coupling pieces 67, 67 into the receiving grooves perfectly. At a side surface inside one of the coupling pieces 67, 67 is formed a taper portion, to which a disengaging pin 69 is engaged. When the coupling pieces 67, 67 are retracted into the receiving hole perfectly to release the combination, the disengaging pin 69 is slid axially to push a bottom surface of the cylindrical hole 62 so that it disengages a bitten combination between a peripheral surface of the taper cylindrical portion 61 and an inside surface of the taper inside opening 65. The hexagonal wrench socket can be formed on only one side of the screw pin 68, but it may be formed on opposite sides for rotation balance as doted line as shown in FIG. 4. It may be possible to form such axial slits on an inner surface of the taper cylindrical portion 61 in order that the outer surface of the taper cylindrical portion 61 is easily expanded at a little amount by pressing by the coupling pieces 67, 67.

There is a telescopic cover mechanism 70 between the grinding wheel G and the sub radial bearing device 43. The cover mechanism 70 includes a fixed cylindrical cover 71 that is fixed to the sub radial bearing device 43 at its flange portion and that has a cylindrical portion projecting to cover an outer surface of the sub wheel shaft 52. A movable cylindrical cover 72 is slidably mounted on a peripheral surface of the fixed cylindrical cover 71 and is adjusted in an axial direction. The movable cylindrical cover 72 has at an end portion thereof an outer peripheral groove 72*a*, the outer surface of which is faced to an inner peripheral groove 50*c* without contracting each other to construct of a labyrinth seal. Thereby, it is prevented that any invaders such as ground pieces, grinding particles, coolant, etc come into a fitting surface between an inner surface 50*h* of the wheel base 50*a* and the sub wheel shaft 52. A screw portion may be formed on either one or both of the outer and inner grooves 72*a*, 50*c* to exhaust air including the invaders by rotations of the sub wheel shaft 52 and the grinding wheel G. The movable cylindrical cover 72 is fixed by small screws 73 normally. The numeral 75 shows a seal ring.

It is now described an operation of the first embodiment of the present invention. In accordance with instruction of grinding, the workpiece W supported on the spindle head 24 is rotated, and the slide 33 is positioned in the right and left directions and the wheel head 34 is advanced in a rapid feed to make a contact of the rotating grinding wheel G with the rotating workpiece W in order to grind the workpiece W at a grinding feed. At the moment when the wheel slide starts to advance, coolant is fed from the unillustrated coolant supplying device to the feed line 39*a* and discharged from the coolant supplying nozzle 39 to a grinding position at the contact area between the workpiece W and the grinding wheel G.

On the other hand, when a power is fed to the grinding machine the driving motor 36 is energized to keep the rotation of the grinding wheel G thereafter. The main wheel shaft 45 is rotated by receiving from the pulley 48 the rotation force of the belt 37 rotationally driven by the driving motor 36. Tension of the belt 37 act on the pulley 48 is divided and supported into and by the right radial bearing 42 at right side from the pulley 48 and the angular contact bearing 47 at left side, thereby an inclination of the main wheel shaft 45 is prevented so that it eliminats to affect machining accuracy. Because the coupling mechanism 60 combines the sub wheel shaft 52 with the main wheel shaft 44 as a whole, the rotation of the main wheel shaft 44 is transmitted to the sub wheel shaft 52 to rotate therewith bodily so that the grinding wheel G is rotated with the sub wheel shaft 52 as a whole. Since the inner surface 50*h* is fitted tightly to the sub wheel shaft 52 and the main and sub wheel shaft 45, 52 are combined bodily, the grinding wheel G is supported at both sides by the right and left bearing devices 42, 43 in the radial direction so that the grinding wheel G is kept in a center of rotation of the right and left bearing devices 42, 43 strongly and with large stiffness against grinding resistance from the workpiece W to the grinding wheel G.

The grinding wheel G is also supported fixedly by the flange portion 49 of the main wheel shaft 45 and tightly by the outer peripheral surface of the end portion of the sub wheel shaft 52. Thereby, supporting force for the grinding wheel G is divided to both of the main and sub wheel shafts 45, 52 so that it enforces supporting stiffness and the grinding wheel G itself acts as compensation means for compensating the bending moment against them acting on the main and sub wheel shaft 45, 52. Therefore, it is easy to set a center of the grinding wheel G against both wheel shafts 45, 52 and it increases stiffness of both wheel shafts 45, 52 so that it achieves heavy grinding or high performance grinding with increasing the grinding feed against the workpiece W. Since the grinding wheel G does not escape without obeying the grinding resistance so that the high geometrical accuracy is performed. Thrust load against the main and sub wheel shafts 45, 52 bodily is supported by the angular contact bearing 47. The angular contact bearing 47 directly supports the small diameter portion 45 not through hydrostatic bearing film as a hydrostatic thrust bearing so that the thrust stiffness is reinforced, and since the small diameter portion 45 is supported by a small diameter bearing so that heat generation is minimized and power consumption is saved to achieve energy saving.

During bodily rotating the main and sub wheel shafts 45, 52, concerning about the cover mechanism 70 disposed between the grinding wheel G and the left radial bearing device 43 the left side of the movable cylindrical cover 72 shields the outer peripheral surface of the fixed cylindrical cover 71 by the shield ring 75 and the right side of the movable cylindrical cover 72 is also shielded by the labyrinth seal by the outer peripheral groove 72*a* and the inner peripheral groove 50*c* of the wheel base 50*a*. Therefore, the invaders such as ground pieces, grinding particles and coolant scattered around periphery of the grinding wheel G and the main, sub wheel shaft 45, 52 and rotated therewith are prevented from inserting into the fitting portion between the sub wheel shaft 52 and the inner surface 50*h* of the wheel base 50*a* so that it prevents the fitting portion of the sub wheel shaft 52 and the inner surface 50*h* of the wheel base 50*a* from damaging, thereby to maintain forever high accuracy in the fitting therebetween.

During bodily rotating the main and sub wheel shafts 45, 52, the automatic balancing device 54 is operated in the sub wheel shaft 52 to compensate any unbalance in the rotation system including the grinding wheel G and both wheel shafts 45, 52. The output signal from the vibration sensor VS mounted on the unit base 41 is fed from the non-rotatable signal sending/receiving device 55*b* to the rotatable signal sending/receiving device 55*a* without contacting, thereby the rotatable signal sending/receiving device 55*a* controls to drive two motors within the automatic balancing mechanism 54 to adjust a position phase of two weights in order to eliminate the unbalance of the rotation system. The adjustment of the position phase of weights by the motors is controlled in such that the output signal is under a predetermined threshold value. In first embodiment of the present invention, the automatic balancing mechanism 54 is installed in the sub wheel shaft 52 as a slave shaft so that it can be responsive to the unbalance in all rotation system accurately, especially to the unbalance vibration caused by loosed coupling to compensate it accurately. The output signal from the unillustrated AE sensor mounted within the sub wheel shaft 52 is fed from the rotatable signal sending/receiving device 55*a* to the non-rotatable signal sending/receiving device 55*b*. By processing the signal adequately, the instance that the grinding wheel G contacts with the workpiece W is detected and a control such as change of the grinding feed of the wheel slide 34 based on the detected signal.

It is needed to change the grinding wheel G in accordance with ware in the grinding particles layer 50*b* of the grinding wheel G or a change of sorts of ground workpiece W. As shown in FIG. 5(A), the movable cylindrical cover 72 is retracted to a left far exchange position by loosing the small screw 73 (shown in FIG. 4) and the grinding wheel G is released from fitting to the flange portion 49 of the main wheel shaft 45 by removing six bolts 49*a* thereby to shift to left position as shown in FIG. 5(A) too. Thereafter, the wrench WR is inserted into the wrench socket of the screw pin 68 through the insertion holes 45*h* and 61*h* of the flange portion 49 and the taper cylindrical portion 61, thereby to rotate the screw pin 68. Thus, the coupling pieces 67, 67 are retracted into the releasing position buried the pieces 67, 67 into the receiving groove from the coupling position engaged with enlarged hole 63. At this time, the disengaging pin 69 is slid axially to push a bottom surface of the cylindrical hole 62 so that it disengages a bitten combination between the peripheral surface of the taper cylindrical portion 61 and the inner surface of the taper inside opening 65.

The bolts 58 fastening the supporting bracket 57 are loosen and thereby the supporting bracket 57 is retracted with the non-rotatable signal sending/receiving device 55*b* to the retracted position as shown in FIG. 5(B) within a length of the long hole 57*a*. It is possible for the sub wheel shaft 52 to be axially moved easily in the state that it is rotatably supported by hydrostatic pressure of pressurized fluid. As shown in FIG. 5(B), the sub wheel shaft 52 is moved to the left direction by pulling the sub wheel shaft 52 in such that the grinding wheel G is supported by a suitable temporal receiver so that one end of the sub wheel shaft 52 is removed from the shaft coupling mechanism 60 and the grinding wheel G as a result that the grinding wheel is removed.

Then, the grinding wheel G is changed to new one and the new grinding wheel G is installed on the main and sub grinding wheel 45 and 52 to the stage shown in FIG. 3 again by the way of reverse process to said disassembling process. In detail, the sub wheel shaft 52 is inserted into the inner surface 50*h* of the new grinding wheel G and advanced to the coupling position with the main wheel shaft 45, thereby the new grinding wheel G is fixed to the flange portion 49 of the main wheel shaft 45 by the six bolts 49*a* thereby to achieve the vertical surface fitting. Thereafter, the shaft coupling mechanism 60 is operated by the wrench thereby to project the coupling pieces 67, 67 in such the way that they fit tightly into the enlarged hole 63 of the taper cylindrical portion 61. Thereby the outer surface of the taper cylindrical portion 61 is expanded outwardly a little amount thereby to tightly fit the taper cylindrical portion 61 with the taper inside opening 65 as the taper surface fitting. As explained above assembling process, the vertical end surface 52*t* is tightly fitted with the vertical end surface 45*t* each other at first, then the taper cylindrical portion 61 is tightly fitted with the taper inside opening 65 so that the sub wheel shaft 52 is combined firmly with the main wheel shaft 45 by these two tightly fittings of the taper surface fitting and the vertical surface fitting continuous to the taper surface fitting mechanically. Thus, the vertical end surfaces 49*t*, 52*t*, especially the end portions thereof are repulsed each other against the bending moment acting on the wheel shafts 45, 52.

Since the thrust bearing device 44 is fixed to the unit base 41 by a foot portion thereof existing between an upper and a lower portions of the belt 37 running on the pulley 48, the belt 37 is changed in such that the thrust bearing device 44 is maintained the position fixed to the unit base 41 and between the upper and the lower portions of the belt 37. In the above-mentioned disassembling process that the sub wheel shaft is shifted to the left direction in order to remove the grinding wheel G from the sub wheel shaft 52 after the grinding wheel G is removed from the flange portion 49 of the main wheel shaft 45, it may be that after the sub wheel shaft 52 is removed from the grinding wheel G remaining to be fixed to the flange portion 49 of the main wheel shaft 45 by the six bolts 49*a*, the six bolts 49*a* are removed to release the fixing of the grinding wheel G from the flange portion 49.

(Second Embodiment of the Present Invention)

Figure 6:
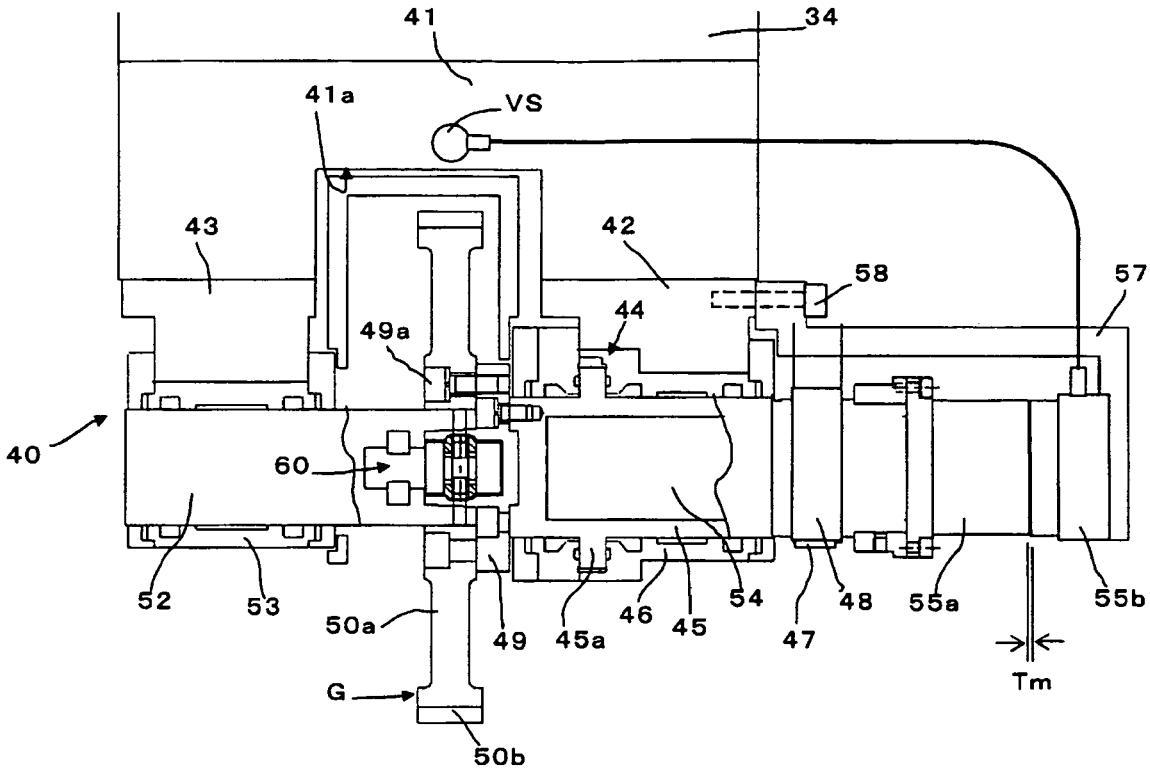
FIG. 6 is a horizontal cross sectional view of the wheel shaft supporting apparatus for the grinding machine according to the second embodiment of the present invention.

The second embodiment of the present invention is described hereinafter referred to FIGS. 6–8. The same numerals in the second embodiment to that in the first embodiment of the present invention are same constructions except for a part so that the explanations of the same numerals are omitted. Main differences of the second embodiment from the first embodiment are as follows; the taper cylindrical portion 61 and the shaft coupling mechanism 60 are formed on and in the main wheel shaft 45; the thrust bearing device 44 is a hydrostatic fluid bearing and installed between a flange 49 and the right bearing metal 46 at a left side from the pulley 48; and the automatic balancing mechanism 54 and the rotatable and non-rotatable signal sending/receiving devices 55*a*, 55*b* are mounted on the main wheel shaft 45 in the second embodiment. The main differences will be explained hereinafter referred to FIGS. 6–8.

The right bearing device 42 includes the thrust bearing device 44 at a left portion thereof. The bearing device 44 comprises an enlarged diameter portion 45*a* formed on the main wheel shaft 45, and opposite sides of the enlarged diameter portion 45*a* are faced to each of right and left thrust bearing surfaces of the bearing metal 46 with a small clearance. Hydrostatic force of pressurized fluid fed into the small clearance supports rotatably the enlarged diameter portion 45*a* with restriction of an axial movement of the main wheel shaft 45.

The pulley 48 is fixed with a key on a right end portion of the main wheel shaft 45 and driven by the driving motor 36 mounted on the rear portion of the wheel slide 34 as described in the first embodiment. Therefore, the diameter of the grinding wheel G is not affected by the diameter of the driving motor as the diameter of the grinding wheel G in a prior art is affected by the diameter of the driving motor so that the small diameter of the grinding wheel G suitable for an exchanging process thereof can be installed in the first embodiment. An axial position of the pulley 48 is determined at a suitable position restricted by the thrust bearing device 44 so that axially relative position of the pulley 48 and the pulley 36*a* are fixed firmly in the axial direction, thereby to transfer rotational force smoothly.

The automatic balancing mechanism 54 and the rotatable and non-rotatable signal sending/receiving devices 55*a*, 55*b* are installed respectively in and on the main wheel shaft 45 instead of being installed in and on the sub wheel shaft 52 in the first embodiment. Therefore, the automatic balancing mechanism 54 is installed in the wheel shaft with the thrust bearing and the pulley so that the automatic balancing mechanism 54 can be supported firmly and be sensitively responsive to the wheel unbalance in rotational direction and precision balancing can be achieved.

Figure 7:
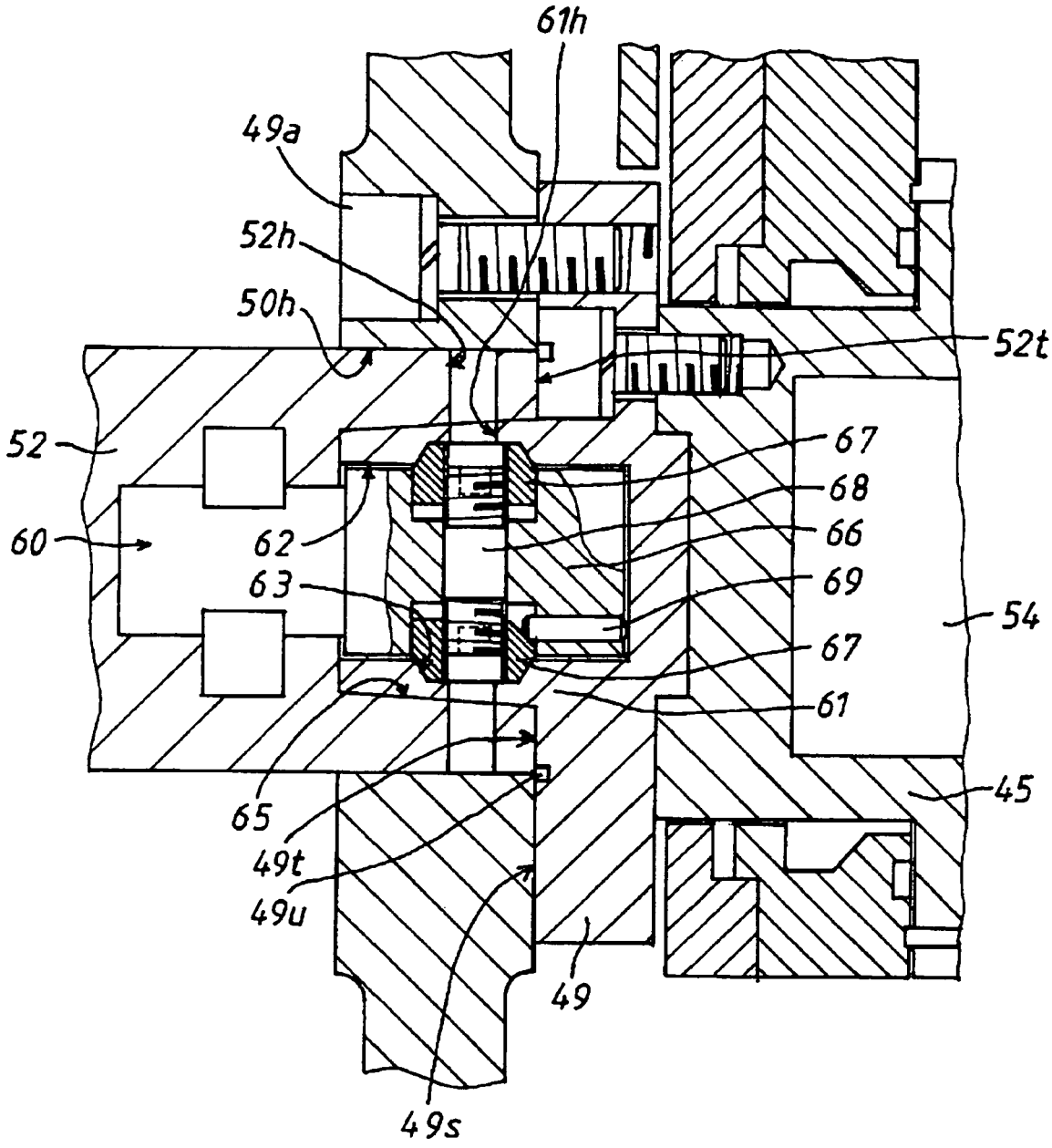
FIG. 7 is a partial enlarged view including the shaft coupling mechanism mounted in wheel shafts and the telescopic cover mechanism covering the shaft coupling mechanism according to the second embodiment of the present invention.
Figure 8:
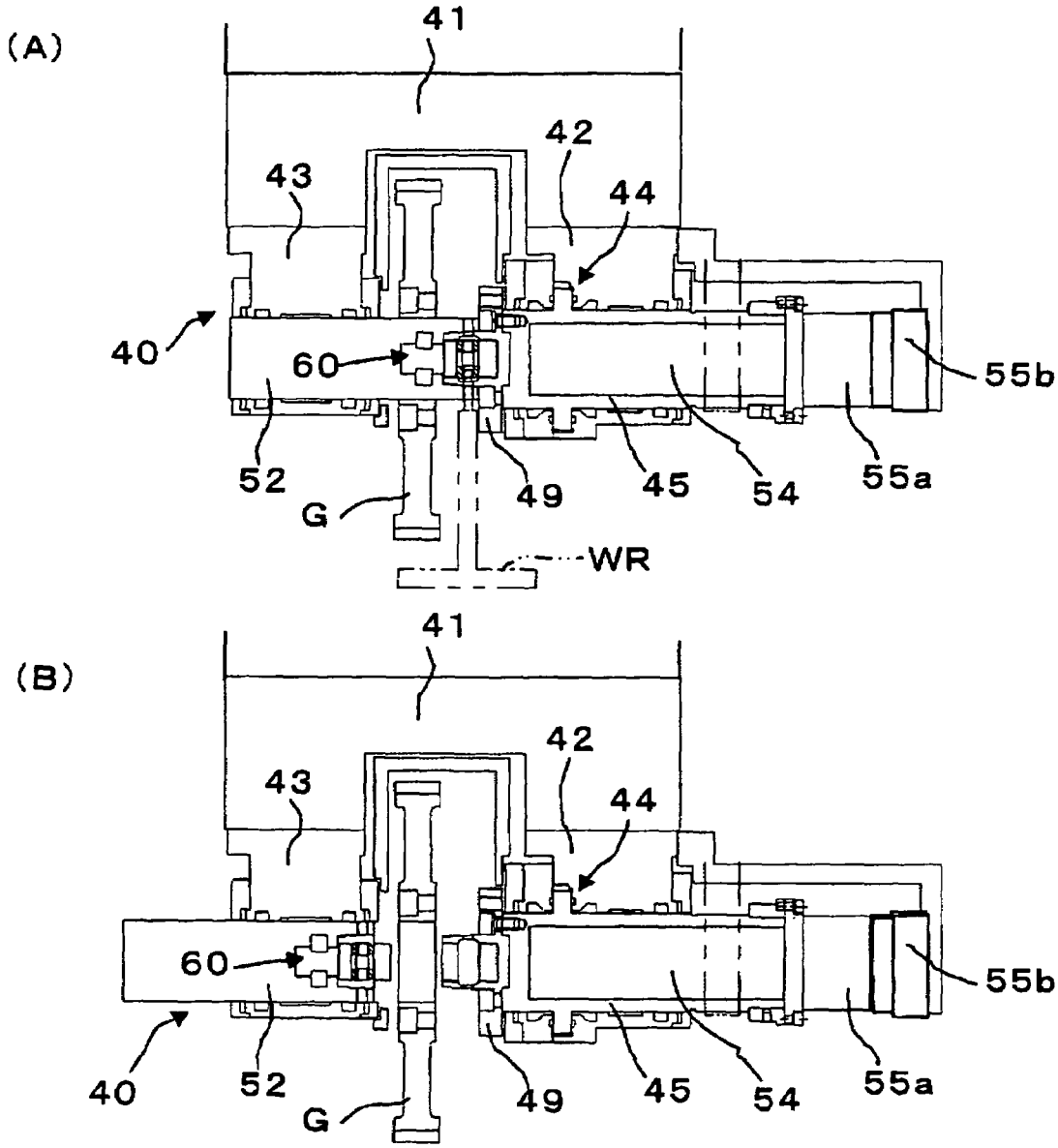
FIGS. 8(A) and (B) are an explanatory diagram for assembling and disassembling the grinding wheel according to the second embodiment of the present invention.

As shown in FIG. 7 partially enlarged, the taper inside opening 65 is formed in the right end of the sub wheel shaft 52 instead of being formed in the main wheel shaft 45 in the first embodiment. The flange portion 49 is mounted on the end surface of the main wheel shaft 45 and the taper cylindrical portion 61 is projected from the flange portion of the main wheel shaft 45. The taper inside opening 65 is tightly fitted with the taper cylindrical portion 61 and the shaft coupling mechanism 60 is installed in the taper cylindrical portion 61. The flange portion 49 has a vertical end surface 49*t* extending from a base of the taper cylindrical portion 61, and the vertical end surface 49*t* is divided by a peripheral groove 49*u* from a wheel attaching surface 49*s*. Faced to the side of the vertical end surface 49*t*, therewith is engaged the vertical end surface 52*t* formed on the end surface of the sub wheel shaft 52 at the opening side of the taper inside opening 65.

Therefore, in the aspect of the present invention according to the second embodiment, the taper cylindrical portion 61 projected from the main wheel shaft 45 formed the thrust bearing device 44 therein is tightly fitted into the inside opening 65 formed in the sub wheel shaft 52 having no thrust bearing mechanism. Thereby, the outer peripheral surface of the sub wheel shaft 52 including the taper inner hole 65 is formed to support the grinding wheel G so that there are three portions of the taper surface fitting portions 61, 65, the vertical surface fitting portions 49*t*, 49*s*, 52*t* of both wheel shafts 45, 52 and inner supporting portion of the grinding wheel G in almost a line of a longitudinal direction of the grinding wheel G so that the bending moment is firmly assisted by the taper surface fitting portions 61, 65 and the vertical surface fitting engaging portions 49*t*, 49*s*, 52*t*.

Besides, in the same center line to that of wrench sockets of the screw pin 68, an insertion hole 52*h* for the wrench WR is formed in the end portion of the sub wheel shaft 52, instead of being formed in the flange portion 49 of the main shaft 45 in the first embodiment, and the insertion hole 61*h* is formed in the taper cylindrical portion 61 transversely in the diameter direction. Therefore, where the grinding wheel G is mounted on both main and sub wheel shafts 45 and 52, the insertion hole 52*h* is shielded by the inner surface 50*h* of the grinding wheel G, that is to say the grinding wheel G operates as a function of shielding valve for the insertion hole 52*h*. In the disassembling process, the grinding wheel G is retracted to the left direction as shown in FIG. 8(A), the insertion hole 52*h* is opened, thereafter, the wrench WR is inserted into the wrench socket of the screw pin 68 through the insertion holes 52*h* and 61*h* of the sub wheel shaft 52 and the taper cylindrical portion 61, thereby to rotate the screw pin 68. Thus, the coupling pieces 67, 67 are retracted into the releasing position buried the pieces 67, 67 into the receiving groove from the coupling position engaged with enlarged hole 63. In the assembling process, the new grinding wheel G is advanced to the engaged position with the flange portion 49, thereby to shield, by the inner surface of the inner surface 50*h*, the insertion hole 52*h* exposed from the surface of the sub wheel shaft 52 thereby to prevent the invaders from entering therein.

The explanation of the operation of the second embodiment of the present invention is omitted because almost of all operation is similar to that in the first embodiment of the present invention except for the some differences based on the differences as defined above and some operations about said some differences are explained above in the second embodiment.

(Third Embodiment of the Present Invention)

The third embodiment of the present invention is described hereinafter referred to FIGS. 9, 10. The same numerals in the third embodiment to that in the first embodiment of the present invention are same constructions except for a part so that the explanations of the same numerals are omitted. Main difference of the third embodiment from the first embodiment is as follows; a flange F is treated as a unit with the grinding wheel G in the third embodiment. Therefore, the grinding wheel G comprises a wheel body Ga and the flange F, thus the flange F is usually secured to the wheel body Ga by the six bolts 49*a* as the unit shown in FIG. 9.

Figure 9:
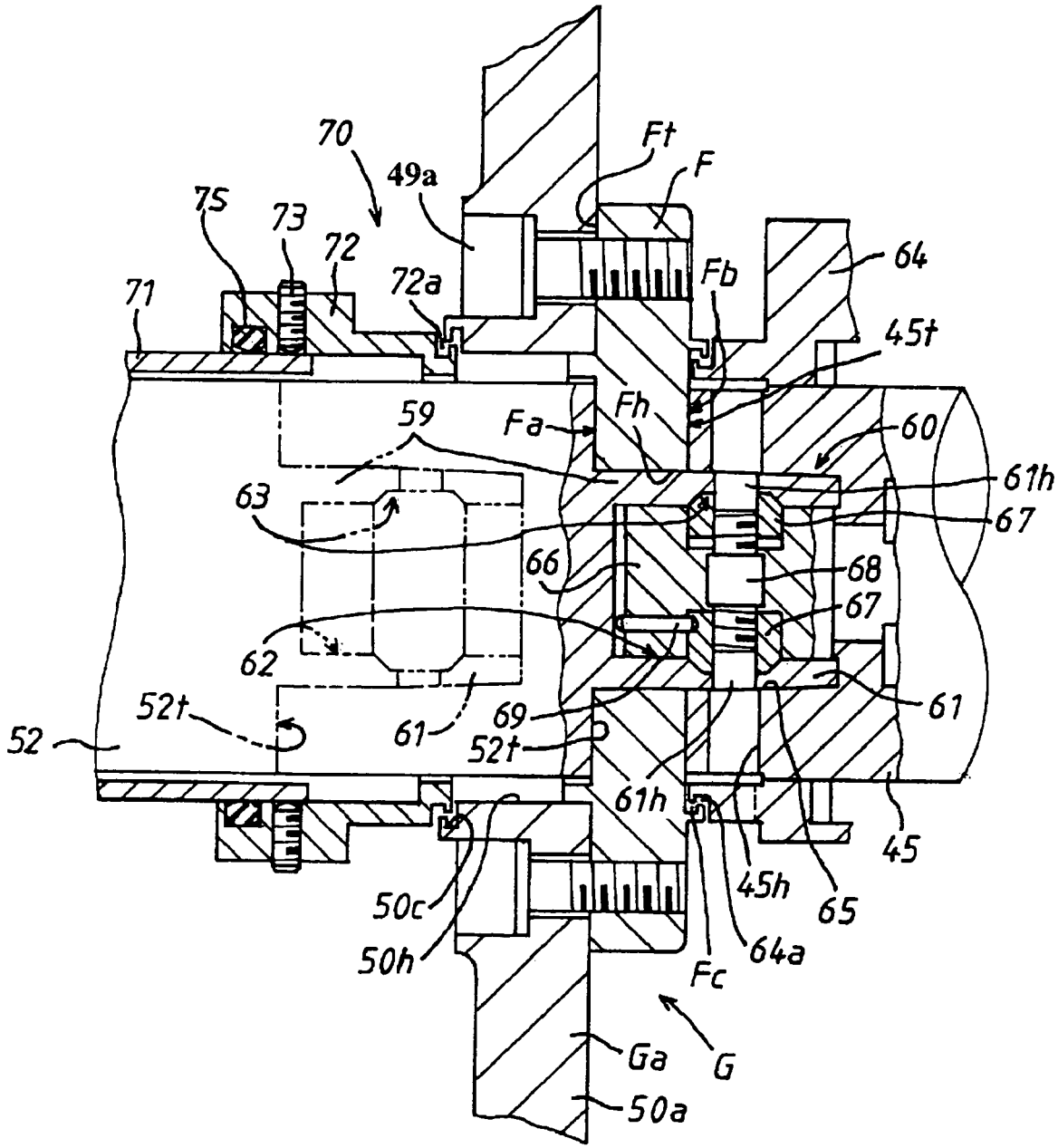
FIG. 9 is a partial enlarged view including the shaft coupling mechanism mounted in wheel shafts and the telescopic cover mechanism covering the shaft coupling mechanism according to the third embodiment of the present invention.
Figure 10:
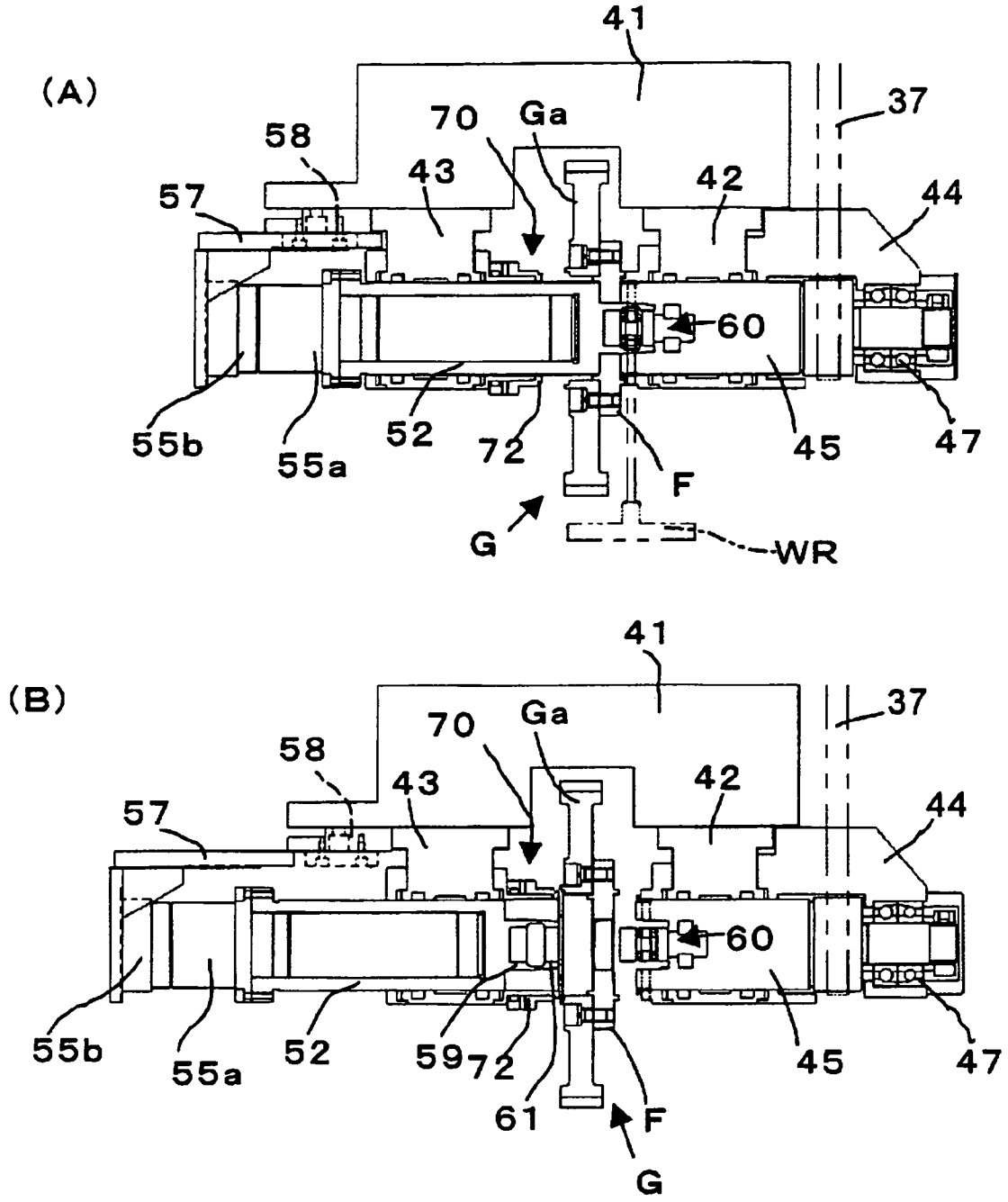
FIGS. 10(A) and (B) are an explanatory diagram for assembling and disassembling the grinding wheel according to the second embodiment of the present invention.

Said FIG. 9 shows an enlarged sectional view of an area of the combining mechanism between the main and sub wheel shafts 45, 52. From the end of the sub wheel shaft 52 is projected the taper cylindrical portion 61 through a straight cylindrical portion 59 tightly fitted by a mounting hole Fh of the flange F. In the taper cylindrical portion 61 are formed the enlarged hole 63 and the cylindrical hole 62 continuing to the straight cylindrical portion 59. The right end surface of the sub wheel shaft 52 forms thereon the vertical end surface 52*t* extending from the base of the straight cylindrical portion 59 outwardly to the direction of the diameter thereof and fitting tightly with a side surface Fa of the flange F. The left end surface of the main wheel shaft 45 forms the vertical end surface 45*t* fitting tightly with the other side surface Fb of the flange F.

Further, a cover mechanism 64 is mounted between the flange F and the radial bearing device 46. The cover mechanism 64 has a labyrinth seal 64*a* forming a labyrinth with a clearance to a circular groove Fc of the flange F. Thereby, it is prevented that any invaders such as ground pieces, grinding particles, coolant, etc come into these fitting surfaces of the inner surface of the flange F, the vertical end surface 45*t* of the main wheel shaft 45 and the cylindrical surface of the straight cylindrical portion 59. The cover mechanism 64 has also a notch portion, as shown by dotted line in FIG. 9, communicating with the inserting hole 45*h*.

Almost of all parts of the operation of the third embodiment of the present invention is omitted to be explained except for the differences from that of the first embodiment. The exception of the operation will be explained hereinafter. The grinding wheel G is supported in such a way that the flange F is supported by fitting tightly with the vertical end surface 45*t* of the main wheel shaft 45 and by fitting tightly with the vertical end surface 52*t* of the sub wheel shaft 52. Since the supporting force of the grinding wheel G is divided into the main and sub wheel shafts 45, 52, it enforces supporting stiffness and the grinding wheel G itself acts as compensation means for compensating the bending moment against them acting on the main and sub wheel shafts 45, 52. Therefore, it is easy to set a center of the grinding wheel G against both wheel shafts 45, 52 and it increases stiffness of both wheel shafts 45, 52 so that it achieves heavy grinding or high performance grinding with increasing the grinding feed against the workpiece W. Since the grinding wheel G does not escape without obeying the grinding resistance so that the high geometrical accuracy is performed.

In the disassembling process, as shown in FIG. 10(A), the wrench is inserted through the notch portion of the cover mechanism 64, the insertion hole 45*h*, 61*h* of the main wheel shaft 45 and the taper cylindrical portion 61 into the wrench socket on the end surface of the screw pin 68 in order to rotate it. The other disassembling and also assembling processes are same to those in the first embodiment except for that, before the retraction of the sub wheel shaft 52 to left direction in the disassembling process, the six bolts 49*a* should be loosen in the first embodiment in order separate the grinding wheel G from the flange 49, however the grinding wheel G in the third embodiment can be removed with the wheel body Ga and the flange F as the unit from the main and sub wheel shafts 45, 52 in remaining in the suitable temporal receiver without loosing the six bolts 49*a*. And also in the assembling process, the six bolts 49*a* should be fastened in the first embodiment, however the grinding wheel G in the third embodiment can be ready to be pre-assembled by fastening the six bolts 49*a* to mount the flange F to the wheel body Ga prior to the assembling process, it can assemble the grinding wheel G on the main and sub wheel shafts 45, 52 without fastening the six bolts 49*a* in the assembling process. Therefore, the assembling and disassembling time for the grinding wheel G is shorten in the assembling and disassembling process. In the assembling process of the third embodiment, after the side surface Fb of the flange F preassembled to the grinding wheel G is contacted with the vertical end surface 45*t*, the coupling mechanism 60 operates two fitting of the taper surface fitting between the taper cylindrical portion 61 and taper inside opening 65 and the vertical surface fitting between the side surface Fb and the vertical end surface 45*t* by pulling the sub wheel shaft 52 to the main wheel shaft 45.

Figure 11:
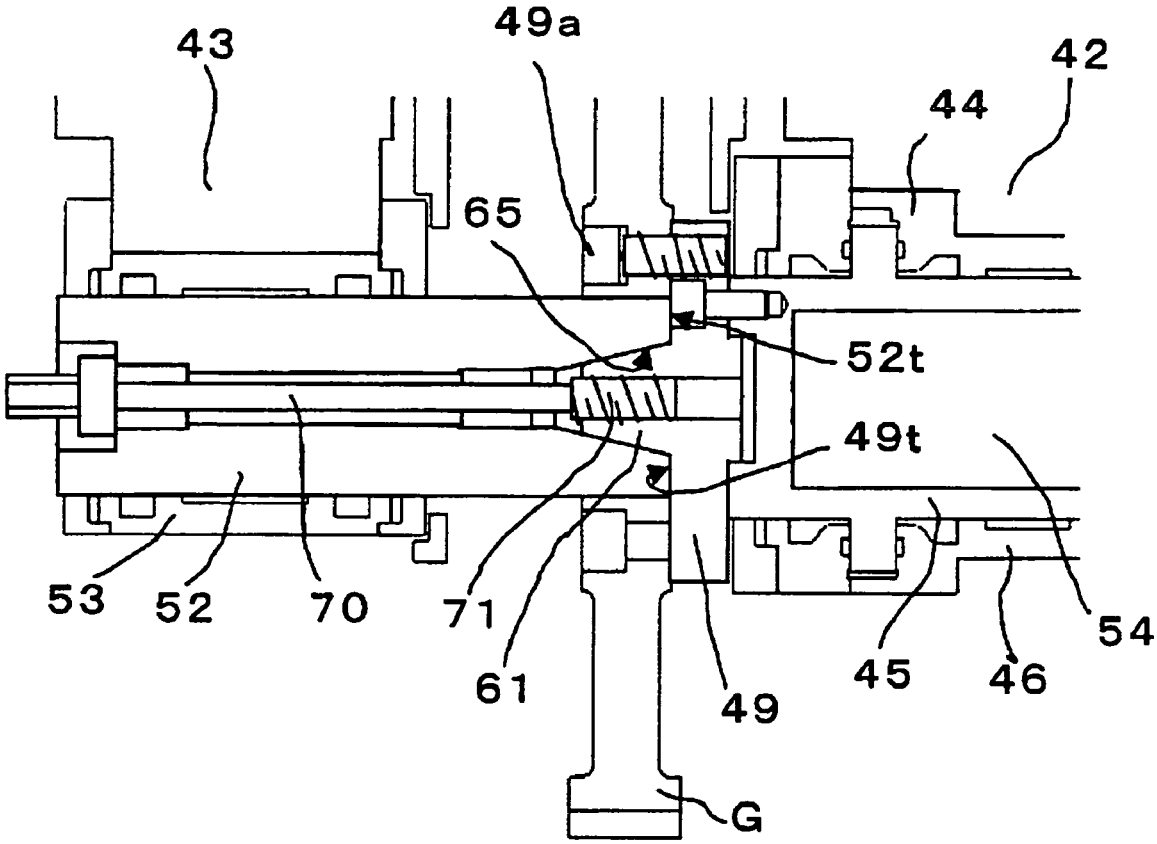
FIG. 11 is a horizontal cross sectional view of the wheel shaft supporting apparatus for the grinding machine according to another embodiment of the present invention.

While the invention has been described in detail with reference to the preferred embodiment, it will be apparent to those skilled in the art that the invention is not limited to the present embodiment, and that the invention may be realized in various other embodiments within the scope of the claims. The example is shown herein under:

(1) FIG. 11 shows the another embodiment of the shaft coupling mechanism 60. An operating rod 70 is rotatably installed at the center of the sub wheel shaft 52, and a screw head 71 on a top end of the operating rod 70 is in a screw engagement with an inner screw portion at an inner screw surface of the taper cylindrical portion 61. Where the operating rod 70 is rotated by an operation portion at the left end of the sub wheel shaft 52, the sub wheel shaft 52 is pressed against the main wheel shaft 52 to achieve the taper surface fitting between the taper cylindrical portion 61 and the taper inside opening 65 and vertical surface fitting between the vertical end surface 49*t* and 52*t*.

(2) The bearing devices 42, 43 are mounted on the wheel head 34 through the unit base 41, however they may be mounted on the wheel head 34 directly.

(3) The vibration sensor VS is installed on the unit base 41, however it may be installed on either one of the radial bearing devices 45 or 52 in which the automatic balancing device 54 is installed.

(4) The thrust bearing device 44 is installed in or on the main wheel shaft 45, however it may be installed in or on the sub wheel shaft 52.

(5) These embodiments are explained for the cylindrical grinding machine, however they may be applied for other type of grinding machines.

Furthermore, the technological components described in this specification and illustrated in the drawings can demonstrate their technological usefulness independently through various other combinations which are not limited to the combinations described in the claims made at the time of application. Moreover, the art described in this specification and illustrated in the drawings can simultaneously achieve a plurality of objectives, and is technologically useful by virtue of realizing any one of these objectives.

What is claimed is:

1. A wheel shaft supporting apparatus for a grinding machine comprising:

a grinding wheel;

a pair of wheel shafts combined and un-combined with each other by relatively moving thereof in an axial direction and supporting said grinding wheel nearby a combining area;

a pair of radial bearing devices mounted on a wheel slide and supporting respectively said pair of wheel shafts rotatably;

a thrust bearing device mounted at one of said radial bearing devices and supporting one of said wheel shafts in a thrust direction;

a shaft coupling mechanism mounted in said wheel shafts for selectively combining and un-combining opposite ends of said wheel shafts;

a taper cylindrical portion formed on and projected from an end surface of one of said wheel shafts;

a taper inside opening formed on an end portion of the other wheel shaft and fitting tightly with said taper cylindrical portion as a taper surface fitting by said shaft coupling mechanism;

a vertical end surface formed on said one wheel shaft and extending from a base of said taper cylindrical portion; and another vertical end surface formed on said end portion of said other wheel shaft and fitting tightly with said vertical end surface of said one wheel shaft as vertical surface fitting, wherein the grinding wheel is supported by said taper surface fitting and said vertical surface fitting continuous with said taper surface fitting.

2. A wheel shaft supporting apparatus for the grinding machine according to claim 1, wherein:

said wheel shaft supporting apparatus further comprises a flange portion extending from either one of wheel shafts in a diameter direction thereof and secured said grinding wheel by bolts; and an inner surface of said grinding wheel fits directly or indirectly on an outer peripheral surface of the remaining of wheel shafts.

3. A wheel shaft supporting apparatus for the grinding machine according to claim 2, wherein:

said shaft coupling mechanism is installed in said taper cylindrical portion and comprises therein an insertion hole in a diameter direction;

said shaft coupling mechanism further comprises a pin installed in said insertion hole and having an operating socket at at least one of ends thereof;

said other wheel shaft comprises an another insertion hole in a line with said insertion hole of said taper cylindrical portion and said socket.

4. A wheel shaft supporting apparatus for the grinding machine according to claim 3, wherein:

said either one of wheel shafts is said one wheel shaft; said remaining wheel shaft is said other wheel shaft;

said inner surface of said grinding wheel shields said another insertion hole when it is fitted on said outer surface of said other wheel shaft.

5. A wheel shaft supporting apparatus for the grinding machine according to claim 4, wherein:

an outer surface of said taper cylindrical portion is expanded outwardly by the shaft coupling mechanism.

6. A wheel shaft supporting apparatus for the grinding machine according to claim 2, wherein:

each of said pair of radial bearing devices is a hydrostatic radial bearing device; and said thrust bearing device is a hydrostatic thrust bearing device.

7. A wheel shaft supporting apparatus for the grinding machine according to claim 6, wherein:

an outer surface of said taper cylindrical portion is expanded outwardly by the shaft coupling mechanism.

8. A wheel shaft supporting apparatus for the grinding machine for the grinding machine according to claim 7, wherein:

said wheel shaft supporting apparatus further comprises an automatic balancing mechanism mounted in said one wheel shaft and automatically balancing a whole rotating system including said both wheel shafts;

said flange portion extends from said wheel shaft in a diameter direction thereof.

9. A wheel shaft supporting apparatus for the grinding machine according to claim 8, wherein:

said wheel shaft supporting apparatus further comprises a pulley installed on said one wheel shaft; and said automatic balancing mechanism is mounted in said one wheel shaft.

10. A wheel shaft supporting apparatus for the grinding machine according to claim 9, wherein:

said hydrostatic thrust bearing device is installed in said hydrostatic radial bearing device of said one wheel shaft;

said shaft coupling mechanism operates to pull said other wheel shaft to said one wheel shaft.

11. A wheel shaft supporting apparatus for the grinding machine according to claim 2, wherein:

each of said pair of radial bearing devices is a hydrostatic radial bearing device; said thrust bearing device is an angular contact thrust bearing device; and said flange portion is projected from said other wheel shaft in a diameter direction thereof.

12. A wheel shaft supporting apparatus for the grinding machine according to claim 11, wherein:

an outer surface of said taper cylindrical portion is expanded outwardly by the shaft coupling mechanism.

13. A wheel shaft supporting apparatus for the grinding machine according to claim 12, wherein:

said wheel shaft supporting apparatus further comprises an automatic balancing mechanism mounted in either one of wheel shafts and automatically balancing a whole rotating system including said both wheel shafts.

14. A wheel shaft supporting apparatus for the grinding machine according to claim 13, wherein:

said wheel shaft supporting apparatus further comprises a pulley installed between said hydrostatic radial bearing device and angular contact thrust bearing device on said other wheel shaft;

said automatic balancing mechanism is mounted in said one wheel shaft; and said angular contact thrust bearing device includes roller bearings supporting said other wheel shaft in not only thrust direction but also radial direction thereby to support a tension acting on said pulley.

15. A wheel shaft supporting apparatus for the grinding machine according to claim 13, wherein:

said wheel shaft supporting apparatus further comprises a restriction member restricting said axial movement of said one wheel shaft that is not supported by said angular contact thrust bearing device; and said shaft coupling mechanism is mounted in said other wheel shaft to operate said taper surface fitting between said taper cylindrical portion and said taper inside opening and said vertical surface fitting between the vertical end surface of said one wheel shaft and said another vertical end surface of said other wheel shaft by pulling said one wheel shaft to said other wheel shaft in said axial direction.

16. A wheel shaft supporting apparatus for the grinding machine according to claim 15, wherein:

said wheel shaft supporting apparatus further comprises a telescopic cover mechanism disposed on said one wheel shaft between the hydrostatic radial bearing device and a side surface of said grinding wheel to prevent an invader from into a fitting surface between an outer surface of said one wheel shaft and an inner surface of said grinding wheel.

17. A wheel shaft supporting apparatus for the grinding machine according to claim 16, wherein:

said telescopic cover mechanism including; a fixed cylindrical cover fixed to said one wheel shaft and covering said outer surface of said one wheel shaft with a clearance; and a movable cylindrical cover is slidably and adjustably mounted on a peripheral surface of said fixed cylindrical cover and having a labyrinth seal portion.

18. A wheel shaft supporting apparatus for the grinding machine according to claim 1, wherein:

said shaft coupling mechanism is installed in said taper cylindrical portion and comprises therein an insertion hole in a diameter direction;

said shaft coupling mechanism further comprises a pin installed in said insertion hole and having an operating socket at at least one of ends thereof;

said other wheel shaft comprises an another insertion hole in a line with said insertion hole of said taper cylindrical portion and said socket.

19. A wheel shaft supporting apparatus for the grinding machine according to claim 18, wherein:

said inner surface of said grinding wheel shields said another insertion hole when it is fitted on said outer surface of said other wheel shaft.

20. A wheel shaft supporting apparatus for the grinding machine according to claim 19, wherein:

an outer surface of said taper cylindrical portion is expanded outwardly by the shaft coupling mechanism.

21. A wheel shaft supporting apparatus for the grinding machine according to claim 1, wherein:

each of said pair of radial bearing devices is a hydrostatic radial bearing device; and said thrust bearing device is a hydrostatic thrust bearing device.

22. A wheel shaft supporting apparatus for the grinding machine according to claim 21, wherein:

an outer surface of said taper cylindrical portion is expanded outwardly by the shaft coupling mechanism.

23. A wheel shaft supporting apparatus for the grinding machine according to claim 22, wherein:

said wheel shaft supporting apparatus further comprises an automatic balancing mechanism mounted in either one of wheel shafts and automatically balancing a whole rotating system including said both wheel shafts.

24. A wheel shaft supporting apparatus for the grinding machine according to claim 23, wherein:

said wheel shaft supporting apparatus further comprises a pulley installed on said one wheel shaft; and said automatic balancing mechanism is mounted in said one wheel shaft.

25. A wheel shaft supporting apparatus for the grinding machine according to claim 24, wherein:

said hydrostatic thrust bearing device is installed in said hydrostatic radial bearing device of said one wheel shaft;

said shaft coupling mechanism operates to pull said other wheel shaft to said one wheel shaft.

26. A wheel shaft supporting apparatus for the grinding machine according to claim 1, wherein:

each of said pair of radial bearing devices is a hydrostatic radial bearing device; and said thrust bearing device is an angular contact thrust bearing device.

27. A wheel shaft supporting apparatus for the grinding machine according to claim 26, wherein:

an outer surface of said taper cylindrical portion is expanded outwardly by the shaft coupling mechanism.

28. A wheel shaft supporting apparatus for the grinding machine according to claim 27, wherein:

said wheel shaft supporting apparatus further comprises an automatic balancing mechanism mounted in either one of wheel shafts and automatically balancing a whole rotating system including said both wheel shafts.

29. A wheel shaft supporting apparatus for the grinding machine according to claim 28, wherein:

said wheel shaft supporting apparatus further comprises a pulley installed between said hydrostatic radial bearing device and angular contact thrust bearing device on said other wheel shaft;

said automatic balancing mechanism is mounted in said one wheel shaft; and said angular contact thrust bearing device includes roller bearings supporting said other wheel shaft in not only thrust direction but also radial direction thereby to support a tension acting on said pulley.

30. A wheel shaft supporting apparatus for the grinding machine according to claim 28, wherein:

said wheel shaft supporting apparatus further comprises a restriction member restricting said axial movement of said one wheel shaft that is not supported by said angular contact thrust bearing device; and said shaft coupling mechanism is mounted in said other wheel shaft to operate said taper surface fitting between said taper cylindrical portion and said taper inside opening and said vertical surface fitting between the vertical end surface of said one wheel shaft and said another vertical end surface of said other wheel shaft by pulling said one wheel shaft to said other wheel shaft in said axial direction.

31. A wheel shaft supporting apparatus for the grinding machine according to claim 30, wherein:

said wheel shaft supporting apparatus further comprises a telescopic cover mechanism disposed on said one wheel shaft between the hydrostatic radial bearing device and a side surface of said grinding wheel to prevent an invader from into a fitting surface between an outer surface of said one wheel shaft and an inner surface of said grinding wheel.

32. A wheel shaft supporting apparatus for the grinding machine according to claim 29, wherein:

said telescopic cover mechanism including; a fixed cylindrical cover fixed to said one wheel shaft and covering said outer surface of said one wheel shaft with a clearance;

a movable cylindrical cover is slidably and adjustably mounted on a peripheral surface of said fixed cylindrical cover and having a labyrinth seal portion.

33. A wheel shaft supporting apparatus for the grinding machine according to claim 1, wherein:

said flange portion extending from said one wheel shaft in a diameter direction thereof and secured said grinding wheel by bolts;

said taper cylindrical portion formed on and projected from said end surface of said one wheel shaft through a straight cylindrical portion; and an inner surface of said flange portion fits on said straight cylindrical portion of said one wheel shaft.

34. A wheel shaft supporting apparatus for the grinding machine according to claim 33, wherein:

an outer surface of said taper cylindrical portion is expanded outwardly by the shaft coupling mechanism.

35. A wheel shaft supporting apparatus for the grinding machine comprising:

a grinding wheel;

a pair of wheel shafts combined and un-combined with each other by relatively moving thereof in an axial direction and supporting said grinding wheel nearby a combining area;

a flange portion extending from either one of the wheel shafts in a diameter direction thereof and secured to said grinding wheel by bolts;

a pair of hydrostatic radial bearing devices mounted on a wheel slide and supporting respectively said pair of wheel shafts rotatably;

a thrust bearing device mounted at one of said radial bearing devices and supporting one of said wheel shafts in a trust direction;

a taper cylindrical portion formed on and projected from an end surface of one of said wheel shafts;

a taper inside opening formed on an end portion of the other wheel shaft and fitting tightly with said taper cylindrical portion as a taper surface fitting by said shaft coupling mechanism;

a shaft coupling mechanism mounted in said taper cylindrical portion for selectively combining and un-combining opposite ends of said wheel shafts, said shaft coupling mechanism including an insertion hole in a diameter direction and a pin installed in said insertion hole and having an operating socket at at least one of the ends thereof, and said other wheel shaft has an another insertion hole in a line with said insertion hole of said taper cylindrical portion and said socket;

a vertical end surface formed on said one wheel shaft and extending from a base of said taper cylindrical portion; and another vertical end surface formed on said end portion of said other wheel shaft and fitting tightly with said vertical end surface of said one wheel shaft as vertical surface fitting, wherein the grinding wheel is supported by said taper surface fitting and said vertical surface fitting continuous with said taper surface fitting.

36. A wheel shaft supporting apparatus for the grinding machine according to claim 35, wherein:

an outer surface of said taper cylindrical portion is expanded outwardly by the shaft coupling mechanism.

37. A wheel shaft supporting apparatus for the grinding machine according to claim 36, wherein:

said wheel shaft supporting apparatus further comprises an automatic balancing mechanism mounted in either one of wheel shafts and automatically balancing a whole rotating system including said both wheel shafts.

38. A wheel shaft supporting apparatus for the grinding machine according to claim 35, wherein:

said thrust bearing device is an angular contact thrust bearing device.

* * * * *